US007389972B2

(12) United States Patent
Mathias

(10) Patent No.: US 7,389,972 B2
(45) Date of Patent: Jun. 24, 2008

(54) LIFTING SYSTEM WITH OVERLOAD PROTECTION CIRCUIT

(75) Inventor: Andrew J. Mathias, Sycamore, OH (US)

(73) Assignee: Concept 2 Market, Inc., Toledo, OH (US)

( * ) Notice: Subject to any disclaimer, the term of this patent is extended or adjusted under 35 U.S.C. 154(b) by 45 days.

(21) Appl. No.: 11/491,412

(22) Filed: Jul. 21, 2006

(65) Prior Publication Data

US 2007/0023742 A1 Feb. 1, 2007

Related U.S. Application Data

(60) Provisional application No. 60/702,535, filed on Jul. 26, 2005.

(51) Int. Cl.
*B66D 1/50* (2006.01)

(52) U.S. Cl. ..... 254/275; 254/361

(58) Field of Classification Search ..... 254/274, 254/275, 361

See application file for complete search history.

(56) References Cited

U.S. PATENT DOCUMENTS 6,595,493 B2 * 7/2003 Krebs et al. ..... 254/266
6,644,629 B1 * 11/2003 Higashi et al. ..... 254/361
6,886,812 B2 * 5/2005 Kazerooni ..... 254/270

* cited by examiner

*Primary Examiner*—Emmanuel M Marcelo
(74) *Attorney, Agent, or Firm*—Fraser Clemens Martin & Miller LLC; Donald R. Fraser

(57) ABSTRACT

A pneumatically operated hoist system including a load support is disclosed, wherein the system is capable of sensing an overload and preventing the raising of the load support.

10 Claims, 3 Drawing Sheets

LIFTING SYSTEM WITH OVERLOAD PROTECTION CIRCUIT

CROSS-REFERENCE TO RELATED APPLICATION

This application claims the benefit of provisional patent application No. 60/702,535, filed Jul. 26, 2005.

FIELD OF THE INVENTION

The present invention relates to lifting systems and more particularly to a system which will prevent the system to attempt to lift the load should the load exceed a predetermined amount.

BACKGROUND OF THE INVENTION

Many industrial applications utilize air operated hoist systems to enable loads to be lifted. Air hoists are equipped with air motors which are sized to provide a specific maximum lifting capacity (i.e., ¼ Ton, ½ Ton, 1 Ton, etc.). The hoist controls typically control the vertical movement of the lifting mechanism. When in a lifting mode, the hoist will have the capability to lift up a predetermined rated lift capacity.

Many applications require a tool or lifting device, suspended from the hoist to engage the load. These devices are called "End-Effectors" or "Below the Hook Tooling". It is very common for the end-effector tooling and load to weigh less than the rated lifting capacity of the air hoist. Therefore, excess capacity remains for the hoist to lift a greater load. This can create an unsafe environment in many industrial applications.

Examples of safety related issues may be:

1. Attempting to lift heavier objects than the rated capacity of the end-effector tool, which may be less than the hoist. The hoist could continue to lift and the tool be placed in an unsafe condition. A further problem may occur wherein the hoist applies a maximum lift force against a load to be lifted, where the load is too heavy for the hoist to lift. Upon removing the load from the hoist, the hoist may continue to supply the maximum lift force, causing the end-effector tool to abruptly lift upward with the maximum lift force, possibly damaging equipment, tooling, or placing the operator in an unsafe situation.

2. The tool and/or load contacting an obstacle such as an adjacent shelf or a machine component. The hoist may have the lifting capacity to continue an upward movement possibly damaging equipment, tooling, or placing the operator in an unsafe situation.

It is an object of the present invention to produce a pneumatically operated hoist system which is capable of sensing an overload and preventing any further flow of the supply of pressure operating fluid.

SUMMARY OF THE INVENTION

The above object of the invention may typically be achieved by a pneumatic overload protection circuit comprising: a source of pressure fluid; pressure fluid actuated hoist including a load handling device; conduit means providing pressure fluid communication between the source of pressure fluid and the hoist; and a sensor for sensing the load imposed on the load handling device to control the flow of pressure fluid through the conduit means between the source of pressure fluid and the hoist.

BRIEF DESCRIPTION OF THE DRAWINGS

The above object as well as other objects and advantages of the invention will become readily apparent to those skilled in the art from reading the following detailed description of a preferred embodiment of the invention in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner.

Figure 1:
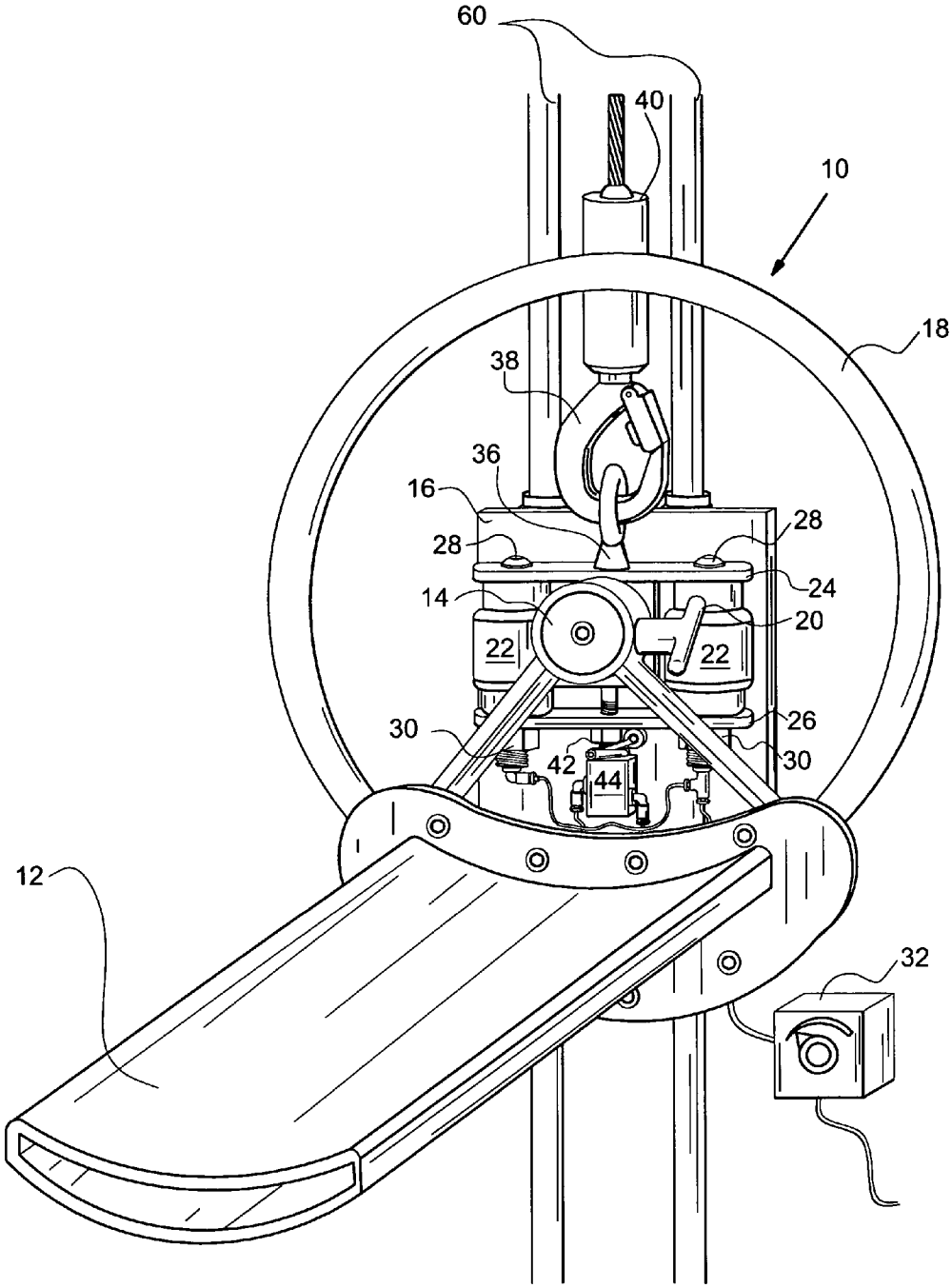
FIG. 1 is an enlarged fragmentary perspective view of a lifting hoist incorporating a pressure fluid overload circuit embodying the features of the present invention.
Figure 2:
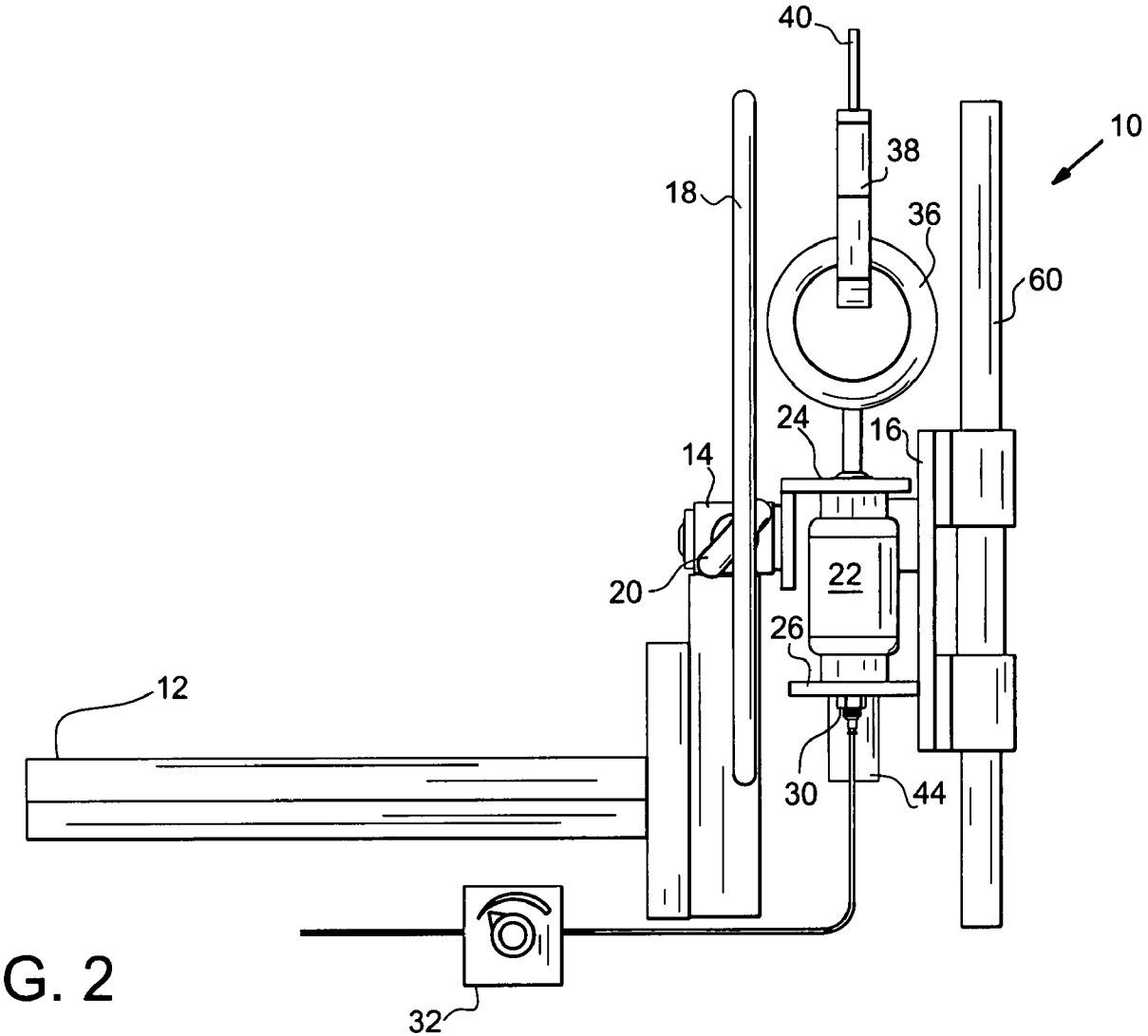
FIG. 2 is a side view of the hoist illustrated in FIG. 1.

FIGS. 1 and 2 show a lifting hoist 10 in accordance with an embodiment of the invention. The hoist 10 is typically attached to a crane that can be used to rotate the hoist 10 about a longitudinal axis, and can also move the hoist 10 in a horizontal direction. The hoist 10 includes an end-effector tooling 12 for supporting a load to be lifted. The end-effector tooling 12 may be mounted on a bracket 14 which is rotatably mounted to a backing plate 16. The end-effector tooling 12 and the associated bracket 14 are guided through different pivotal positions by an operating ring 18 which may be grasped by an operator to facilitate rotation of the end-effector tooling 12. The position of the bracket 14 may be fixed by a locking pin and handle 20.

A pneumatic device including two airbags 22 is disposed between an upper hoist load hook guide plate 24 and a spaced apart lower hoist hook mounting plate 26. In a preferred embodiment, the airbags 22 have a 1¼" diameter. Threaded fastening means 28 are employed to connect the upper ends of the airbags 22 to the upper hoist load hook guide plate 24 which in turn is secured to the backing plate 16. The lower ends of the airbags 22 are fastened to the plate 26 by threaded fasteners 30 which also provide a communication between a source of fluid pressure and the airbags 22 through a regulator 32. The airbags 22 are employed to vary the amount of energy required to move the plates 24 and 26 toward one another by order to vary the energy required to compress the airbags 22. The airbags 22 may be manually adjusted to control an amount of fluid pounds per square inch (p.s.i.) to be maintained in the airbags 22. The amount of fluid p.s.i. maintained in the airbags 22 will determine the lifting capacity of the hoist 10.

An eye bolt 36 extends through apertures formed in the hoist load hook guide plate 24 and the hoist hook mounting plate 26. The eye bolt 36 receives the attachment means 38 which is attached to a raising/lowering device 40. The threaded end of the eye bolt 36 is adapted to extend through an aperture in the plate 26 and receives a nut 42 attached thereto. The nut 42 contacts a lower surface of the hoist hook mounting plate 26 and limits downward movement of the hoist hook mounting plate 26.

A limit switch assembly 44 is mounted on the backing plate 16 and includes a pivotally mounted arm that is biased to contact the hoist hook mounting plate 26. Normally the pivotally mounted arm of the limit switch assembly is in contact with the lower surface of the hoist hook mounting plate 26.

Figure 3:
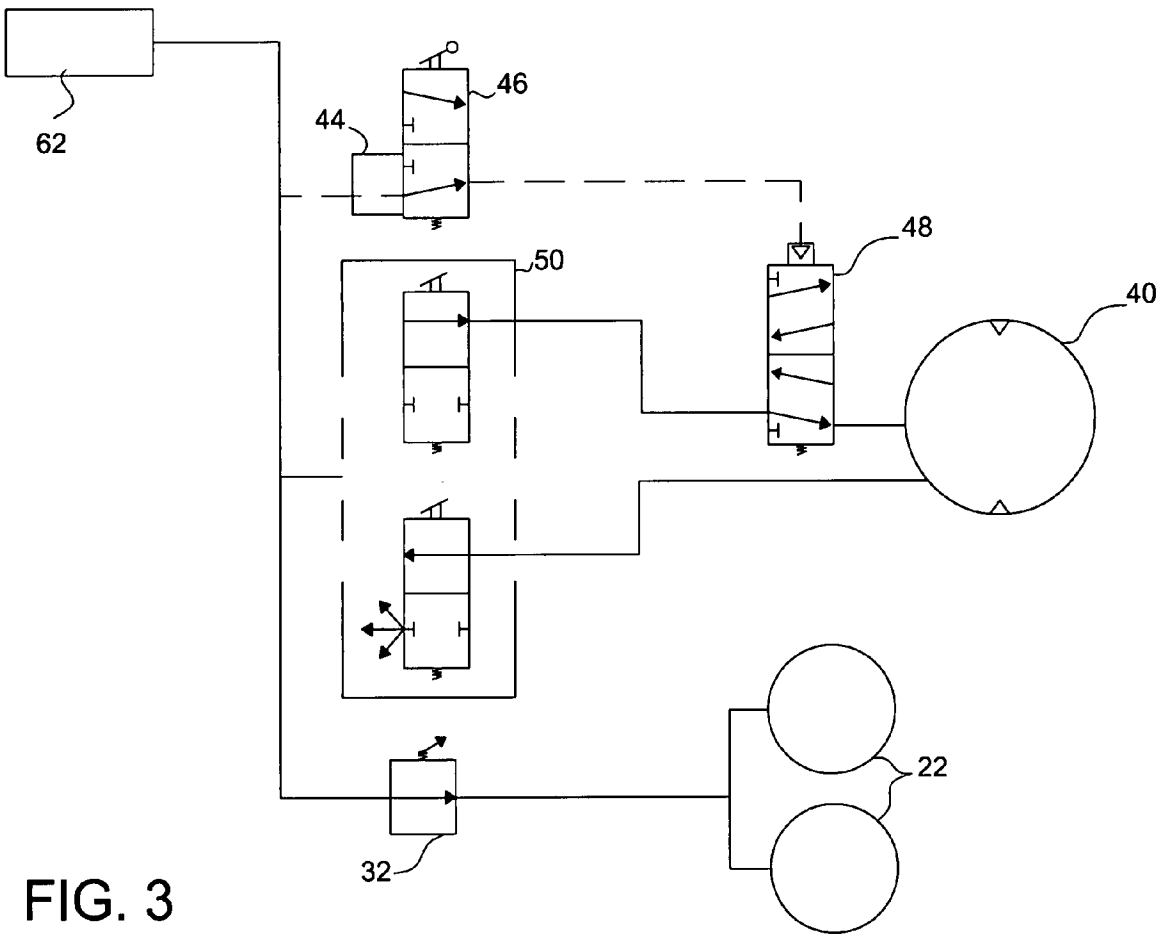
FIG. 3 is a schematic illustration of the operative control circuit of the invention.

The limit switch 44 is connected to a pilot valve 46 shown in FIG. 3. The pilot valve 46 permits the passage of pressure fluid therethrough while the pivotal arm of the limit switch 44 is in a first position. If the arm is moved into a second position by upward movement of the mounting plate 26, the limit switch 44 causes the pilot valve 46 to move into a second position to prevent the flow of pressure fluid therethrough. The pilot valve 46 is in fluid communication with a control valve 48, which in turn, is in fluid communication with the raising/lowering device 40 and is in pneumatic communication with a control panel 50. The control panel 50 may be manually operated to send an appropriate signal to raise and lower the raising/lowering device 40. If the pilot valve 46 is positioned to permit the flow of fluid therethrough, a fluid pilot signal flows to the control valve 48 permitting the flow of fluid to the raising/lowering device 40, thereby allowing the raising/lowering device 40 to move upwardly. Pressure fluid may be allowed to flow to atmosphere from the raising/lowering device 40 thereby causing the raising/lowering device 40 to move downwardly. However, if the pilot valve 46 is positioned to prevent the flow of pressure fluid therethrough, the fluid pilot signal does not flow to the control valve 48 and is caused to move into a second position. While in the second position, the control valve 48 prevents the flow of pressure fluid to the raising/lowering device 40, thereby preventing the raising/lowering device 40 moving upwardly. However, pressure fluid is permitted to flow from the raising/lowering device 40 to atmosphere, thereby allowing the raising/lowering device 40 to move downwardly.

The hoist load hook guide plate 24, the load support bracket 14, and the limit switch assembly 44 are mounted on the backing plate 16 which is slidably mounted on a pair of spaced apart vertically extending guide rails 60. The backing plate 16 may be adjusted to any desired position between the upper and lower position. The raising/lowering device 40 may be used to adjust the position of the backing plate 16 in accordance with the operation of the control panel 50.

FIG. 3 shows a schematic illustration of the circuit for controlling the operation of the apparatus illustrated and described in FIGS. 1 and 2. In operation, pressure fluid is supplied from a pressure fluid source 62. Satisfactory results have been obtained by producing dry clean air at 90 p.s.i. Pressure fluid is supplied from the source 62 to the pilot valve 46. Pressure fluid is permitted to flow through the pilot valve 46 to the control valve 48, thereby causing the valve to be positioned in a first position. In the first position, the control valve 48 permits the flow of pressure fluid from the main pressure fluid source 62 through the control valve 48 to the raising/lowering device 40. Pressure fluids may also be permitted to flow from the raising/lowering device 40 to atmosphere. Accordingly, the raising/lowering device 40 is permitted to move upwardly and downwardly respectively. In the second position of the pilot valve 46 as discussed above, the flow of fluid through the pilot valve 46 is prevented, thereby causing the control valve 48 to move to a second position. In the second position, the flow of pressure fluid from the pressure fluid source 60 through the control valve 48 to the raising/lowering device 40 is prevented. Accordingly, upward movement of the hoist 10 is prevented. However, pressure fluid is permitted to flow from the raising/lowering device 40 to atmosphere permitting downward movement.

The pressure regulator 32, manually controls the amount of pressure to be maintained in the airbags 22. Once a desired pressure is achieved in the airbags 22, the regulator 32 prevents the flow of fluid therethrough. If it is desired to reduce the pressure in the airbags 22, the regulator 32 can be manually operated to permit the flow of pressure fluid to exit the airbags 22 to atmosphere.

In use, the crane is manually adjusted to position the hoist 10 in a desired location. The regulator 32 is manually adjusted to inflate the airbags 22 to a predetermined setting that includes the weight of the end-effector tooling 12 and the prescribed load weight to be lifted, plus 10%, for example, thereafter, the control panel 50 is manually adjusted by the operator to raise and lower the raising/lowering device 40.

To facilitate a raising of the raising/lowering device 40, an appropriate signal from the control panel 50 causes the pressure fluid source 62 to supply pressure fluid through the pilot valve 46 and the control valve 48 to the raising/lowering device 40, thereby causing the raising/lowering device 40 to move upwardly. The upward movement of the raising/lowering device 40 causes the eye bolt 36 and the hoist hook mounting plate 24 to move upwardly. The hoist hook mounting plate 24 applies a force against the airbags 22. If the force applied to the airbags 22 by the hoist hook mounting plate 24 is less than or equal to the force created by the pressure fluid in the airbags 22, the hoist load hook guide plate 24 is caused to move upwardly with the raising/lowering device 40. Since the hoist load hook guide plate 24 is mounted to the backing plate 16, the backing plate 16 will be caused to move upwardly along with the raising/lowering device 40. The limit switch assembly 44, the bracket 14, and the end-effector tooling 12 also move upwardly along with the raising/lowering device 40, until the signal from the control panel is terminated or the raising/lowering device 40 reaches a maximum allowed height.

If the force applied to the airbags 22 by the hoist hook mounting plate 26 exceeds the force created by the pressure maintained in the airbags 22, the airbags 22 will collapse. The collapsing of the bags 22 causes the hoist hook mounting plate 26 to move upwardly and to thereby lose contact with the arm of the limit switch 44, which forces the pivotal arm of the switch 44 and the pilot valve 46 into a second position, wherein the flow of pressure fluid through the pilot valve 46 is prevented. The control valve 48 is thereby caused to move into a second position, wherein the flow of pressure fluid from the source 62 to the raising/lowering device 40 is prevented, and raising of the raising/lowering device 40 is prevented.

To facilitate a lowering of the raising/lowering device 40, an appropriate signal from the control panel 50 causes the raising/lowering device 40 to supply pressure fluid to the atmosphere, thereby causing the raising/lowering device 40 to move downwardly. The downward movement of the raising/lowering device 40 causes the eye bolt 36 and the hoist hook mounting plate 26 to move downwardly and apply a force against the airbags 22. If the force applied to the airbags 22 by the hoist hook mounting plate 20 is less than or equal to the pressure in the airbags 22, the hoist load hook guide plate 24 is caused to move downwardly with the raising/lowering device 40. Since the hoist load hook guide plate 24 is mounted to the backing plate 16, the backing plate 16 is also caused to move downwardly along with the raising/lowering device 40. The limit switch assembly 44, the bracket 14, and the end-effector tooling 12 move downwardly along with the raising/lowering device 40 until the signal from the control panel 50 is terminated or the raising/lowering device 40 reaches a minimum allowed height.

If the pressure on the airbags 22 by the hoist hook mounting plate 26 exceeds the pressure created by the pressure fluid in the airbags 22, the airbags 22 will collapse. The collapsing of the airbags 22 causes the hoist hook mounting plate 26 to move upwardly and to thereby lose contact with the plate contact of the limit switch 44. The loss of the contact of the plate contact of the limit switch 44 with the hoist hook mounting plate 26 causes to pilot valve 46 to move into the second position, wherein the flow of pressure fluid through the pilot valve 46 is prevented. The control valve 48 is thereby caused to move into the second position, wherein the flow of pressure fluid to the raising/lowering device 40 from the main pressure fluid source 62 is prevented. However, pressure fluid flowing from the raising/lowering device 40 is permitted to escape into atmosphere, thereby allowing the raising/lowering 40 device to move downwardly.

The lifting capacity of the hoist 10 is controlled by the amount of fluid maintained in the airbags 22. If an overload condition occurs, the raising of the raising/lowering device 40 is prevented, while the lowering of the raising/lowering device 40 is permitted. When the overload condition has been removed, the hoist 10 reverts to normal operation.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A lifting system comprising:

a load support;

a hoist for lifting and lowering the load support; and control means including a load weight sensor and pressure fluid actuated means for preventing the hoist from lifting the load support upon sensing a load exceeding a predetermined weight.

2. A lifting system as defined in claim 1 wherein the pressure fluid actuated means includes an airbag.

3. A lifting system as defined in claim 2 wherein the airbag is coupled to a source of pressure fluid.

4. A lifting system as defined in claim 1 wherein the pressure fluid actuated means is pneumatic.

5. A lifting system as defined in claim 1 wherein the control means is mounted on a backing plate.

6. A lifting system as defined in claim 5 including bracket means for pivotally mounting the load support to the backing plate.

7. A lifting system as defined in claim 6 wherein the bracket means include manually operated means for pivotally adjusting the load support.

8. A lifting system as defined in claim 7 wherein the manually operated means includes a wheel fixing locking means locking the bracket in related positions.

9. A lifting system as defined in claim 6 wherein the backing plate is vertically adjustable.

10. A lifting system as defined in claim 6 wherein the backing plate is adjustably mounted for selective vertical positions on a pair of spaced apart vertically extending rails.

* * * * *